United States Patent [19]

Mori et al.

[11] Patent Number: 4,612,059

[45] Date of Patent: Sep. 16, 1986

[54] METHOD OF PRODUCING A COMPOSITE MATERIAL COMPOSED OF A MATRIX AND AN AMORPHOUS MATERIAL

[75] Inventors: Hirotaro Mori, Suita; Hiroshi Fujita, Ibaraki, both of Japan

[73] Assignee: Osaka University, Suita, Japan

[21] Appl. No.: 627,679

[22] Filed: Jul. 5, 1984

[30] Foreign Application Priority Data

Jul. 12, 1983 [JP] Japan ..... 58-125549

[51] Int. Cl.[4] ..... C22F 3/00

[52] U.S. Cl. ..... 148/4; 148/403; 148/903

[58] Field of Search ..... 148/403, 4, 39; 428/611, 615, 928, 553, 558

[56] References Cited

U.S. PATENT DOCUMENTS 4,052,201 10/1977 Polk et al. ..... 148/403
4,056,411 11/1977 Chen et al. ..... 148/403
4,122,240 10/1978 Banas et al. ..... 148/4

FOREIGN PATENT DOCUMENTS 0051919 4/1979 Japan ..... 148/403

OTHER PUBLICATIONS

Hansen, "*Constitution of Binary Alloys*", pp. 153, 643, 656, and 742.

*Primary Examiner*—Melvyn J. Andrews
*Assistant Examiner*—S. Kastler
*Attorney, Agent, or Firm*—Spencer & Frank

[57] ABSTRACT

A composite material composed of a matrix and an amorphous material of a desired disposition state is produced by positioning a given shape of crystals of a type easily transformable to an amorphous state by irradiation with a particle ray on the surface and/or the interior of the matrix at a predetermined position, and irradiating the crystals by the particle ray under an irradiation condition of transforming the crystals preferentially to the amorphous state.

11 Claims, 7 Drawing Figures

METHOD OF PRODUCING A COMPOSITE MATERIAL COMPOSED OF A MATRIX AND AN AMORPHOUS MATERIAL

BACKGROUND OF THE INVENTION

The present invention relates to a method of producing a composite material composed of a matrix and an amorphous material.

Recently, there has been a rapid increase in interest in the amorphization of various cyrstals and metals, particularly alloys, as a means for utilizing their functional properties effectively, because the amorphized materials have excellent physical and chemical properties. Amorphous materials produced by amorphization of such materials are desired for use as electronic materials, and also as composite materials composed of amorphous materials and other materials, generally, because of their favorable shapes and sizes. The characteristic properties of an amorphous material become more remarkable when the amorphization extent of the amorphous material approaches perfection; i.e., 100%. However, an amorphous material having such a high extent of amorphization has drawbacks in that the conjunction between the amorphous material and the other material which forms a matrix in the composite material is weak, and that a composite material having a complicated configuration is rarely produced.

Heretofore, as a method of conjugating an amorphous material and a matrix for composing a composite material, there have been developed pressure conjugating methods such as the explosion welding method wherein a given amorphous material is placed on a given matrix and both are subsequently conjugated or bonded mechanically by exertion of a high impact pressure generated by explosion of an explosive etc. However, such methods have shortcomings in that the conjugating property of the welded interface between the amorphous material and the matrix is not reliably established, and the shape of the composite material to be produced is strictly restricted due to the exertion of the high pressure.

SUMMARY OF THE INVENTION

Therefore, an object of the present invention is to obviate the aforementioned drawbacks and shortcomings of the prior art.

Another object of the present invention is to provide a method of producing a composite material of a desired shape with an excellent conjugating property at the conjugated interface between the matrix and the amorphous material, without being restricted strictly to the configuration of the composite material.

The present invention lies in a method of producing a composite material composed of a matrix and an amorphous material, which comprises positioning a given shape of crystals of a type which are easily transformable to an amorphous state by irradiation with a particle ray, such as an electron beam, on the surface and/or the interior of the matrix at a predetermined position, and irradiating the crystals with the electron beam under an irradiation condition of transforming the crystals, i.e., by a solid state transformation preferentially to the amorphous state, while remaining in a solid state whereby a composite material with a desired disposition state of an amorphous phase is obtained.

As crystals of the kind which are easily transformable to the amorphous state by irradiation with a particle ray, use is made of intermetallic compounds such as $Zr_2Al$, $Fe_2Ti$, ZrCu, $V_3Si$, $Cu_3Ti$, NiTi, CoTi, $Cu_3Ti_2$, iron-zirconium series compounds or the like.

BRIEF DESCRIPTION OF THE DRAWINGS

For a better understanding of the present invention, reference is made to the accompanying drawings, in which.

Figure 1:
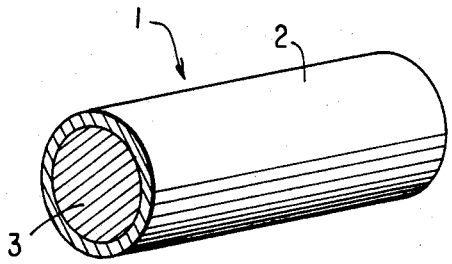
FIG. 1 is a schematic perspective view of a bar or pipe wherein the outer surface of the matrix is enclosed by the amorphous material.
Figure 2:
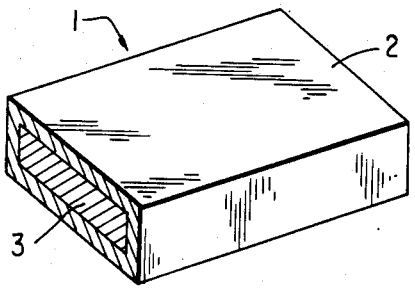
FIG. 2 is a schematic perspective view of a plate-shaped or rectangular-shaped composite material wherein the outer surface of the matrix is enclosed by the amorphous material.
Figure 3:
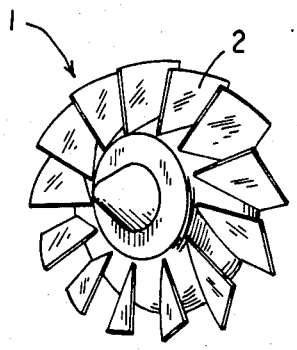
FIG. 3 is a schematic perspective view of a composite material of a complicated configuration wherein the entire surface of the matrix is enclosed by the amorphous material.
Figure 4:
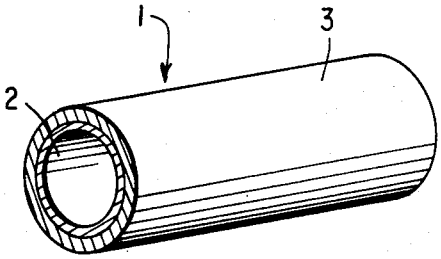
FIG. 4 is a schematic perspective view of a composite material having a hole, the inner surface thereof being coated with the amorphous material.
Figure 5:
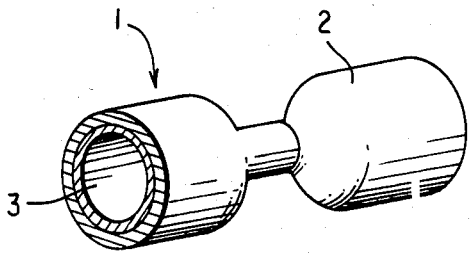
FIG. 5 is a schematic perspective view of a composite material having a cavity of a complicated configuration wherein the outer surface of the matrix is enclosed by the amorphous material.

Throughout different views of the drawings, 1 is the composite material, 2 is the amorphous material, and 3 is a matrix.

DETAILED EXPLANATION OF THE INVENTION

Acceleration voltage, irradiation strength, irradiation temperature, total irradiation dose and the like irradiation conditions are determined depending on the type of crystals to be amorphized.

According to the method of the present invention, a material that cannot be amorphized by itself can be transformed at a desired position to an amorphous phase, regardless of whether the position is on the surface or in the interior of the matrix, whereby an epoch-making composite material can be obtained wherein the excellent characteristic properties of the amorphous phase are utilized to a maximum extent.

Amongst the particles rays for irradiation use, the electron beam is most effective, because it has the largest penetrability or penetrating force.

The interface between the matrix and the amorphous phase is obtained by diffusion conjunction. Therefore, the interface has a remarkably improved intimate conjugating property to both of the matrix and the amorphous material as compared with the mechanical conjunction of the conventional explosion welding method. In a case where a more intimate conjunction is required, the crystals which comprise the starting material or original source of the amorphous phase (to be referred to as the "A-crystal" hereinafter) are amorphized by irradiation with a particle ray, and then the resultant product, as a whole, is subjected to a diffusion annealing treatment at a temperature immediately near or below the crystallization temperature of the amorphous phase, thereby further strengthening the interface. In a case in which the required temperature for the diffusion is higher than the crystallization temperature of the amorphous phase, the resultant product after the irradiation with a particle ray is subjected to such high temperature annealing, and thereafter irradiated again by a particle ray to amorphize again the A-crystal resulted from the high temperature annealing.

According to the method of the present invention, a desired shape of amorphous phase with an interface of a splendid conjunction can be provided at arbitrary portions on the surface and/or the interior of the matrix of various configurations, so that the shortcomings of the conventional mechanical method can be obviated substantially or completely.

According to the present invention, metallic articles such as pipe, bar, plate and article of complicated shapes, crystals reinforced by amorphous fibers, electronic material utilizing amorphous material, and the like, of eminently superior quality, can be assuredly produced exceedingly rapidly, easily and economically on an industrial scale.

DESCRIPTION OF THE PREFERRED EMBODIMENT

Hereinafter, the present invention will be explained in more detail with reference to Examples which, however, should not be construed by any means as limitations of the present invention.

EXAMPLES 1–4

In the Examples, the method of producing a composite material according to the present invention will be explained concretely in succession.

First, an A-crystal is position in a desired shape at a predetermined position or positions of the matrix, e.g., as shown FIGS. 1–7. Positioning of the A-crystal is performed in the following ways, depending on the desired position and shape of the A-crystal.

(a) In the case of positioning the A-crystal on a part or the whole of the matrix surface, e.g., as shown in FIGS. 1–5. The A-crystal is conjugated on the predetermined surface of the matrix by means of electrodeposition, welding, thermal spray, sputtering, vapor deposition, or other electrical or mechanical means.

Figure 6:
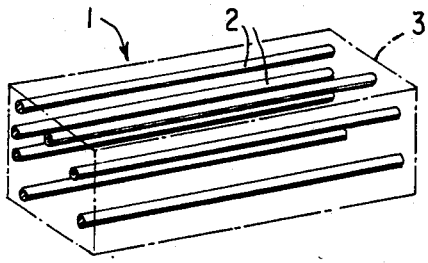
FIG. 6 is a schematic perspective view of a composite material wherein the amorphous material is positioned in a desired fiber-shape or pipe-shape at predetermined positions in the interior of the matrix.
Figure 7:
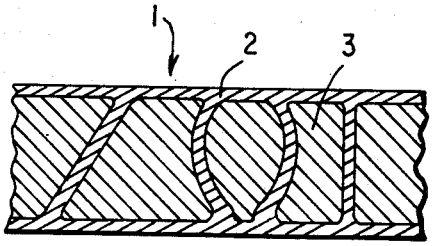
FIG. 7 is a schematic perspective view of a composite material wherein the amorphous material is positioned in arbitrary shapes and independent or connected forms in the interior of the matrix.

(b) In the case of positioning the A-crystal in the interior of the matrix, e.g., as shown in FIGS. 6–7. There are the following three ways (i)–(iii).

(i) Elemental pieces of a matrix on which surface the A-crystal has been conjugated preliminarily are bundled mechanically into a desired form of bundle, and then subjected to a thermal treatment to completely diffusion conjugate the elemental pieces with each other.

(ii) A matrix or a bundle of pieces of matrix is treated by a combined treatment consisting of a mechanical processing and a thermal treatment to form or precipitate the A-crystal of a given shape at a desired position of the matrix.

(iii) A lattice defect in the form of a dislocation line, a stacking fault, a crystal grain boundary, a foreign phase interface etc. is introduced or positioned in a desired state with regard to position and shape thereof in a matrix, and atoms constituting the A-crystal are preferentially diffused therealong, to form or precipitate the A-crystal of a desired state.

The A-crystal positioned on the surface and/or the interior of the matrix according to either one of the above ways is subsequently amorphized promptly by a succeeding irradiation with a particle ray to obtain a composite material composed of the matrix and the amorphous material of a desired positioning state. In this circumstance, if acceleration voltage of the particle ray is higher, the amorphization of the A-crystal proceeds more rapidly, more deeply and more uniformly. If the acceleration voltage is higher than the voltage which causes damage to the matrix (threshold voltage), various lattice defects owing to irraidation damage are caused in the matrix also, so that mutual diffusion is promoted and hence more intimate conjunction between the matrix and the amorphous material can be attained.

The term "damage" used herein means that an arrangement of atoms constructing a crystal of metal or alloy is disturbed.

Illustrative examples of the composite material produced according to the method of the present invention are shown in the following Table 1. In the Table 1, a means for positioning the A-crystal, a particle ray used for the irradiation, and irradiation conditions are also shown.

TABLE 1

| Example | A-crystal | Matrix | Method of positioning the A-crystal | Particle ray for irradiation | Acceleration voltage (MeV) | Irradiation strength ($e/m^2 \cdot sec$) | Irradiation temperature (°K.) | Irradiation time (sec) |
|---|---|---|---|---|---|---|---|---|
| 1 | $Zr_2Al$ | $Zr_3Al$ | precipitation | electron beam | 2 | $9 \times 10^{23}$ | 170 | 60 |
| 2 | $Fe_2Ti$ | FeTi | " | " | " | $8 \times 10^{23}$ | 157 | 360 |
| 3 | $Co_2Ti$ | CoTi | " | " | " | $1.1 \times 10^{24}$ | 160 | 180 |
| 4 | $Cu_3Ti_2$ | $Cu_4Ti$ | " | " | " | $1.0 \times 10^{24}$ | 230 | 120 |

As is apparent from the foregoing description, the method according to the present invention can assuredly produce a composite material of excellent quality exceedingly rapidly, easily and economically on an industrial scale, so that it is eminently useful industrially.

Although the invention has been described with a certain degree of particularly, it is understood that the present disclosure has been made only by way of example, and that many variations and modifications thereof are possible to those skilled in the art without departing from the broad aspect and scope of the invention as hereinafter claimed.

What is claimed is:

1. A method of producing a composite material comprising the steps of positioning an intermetallic starting material at a predetermined position in a matrix, which position is at least one of within the matrix and on a surface of the matrix, said starting material consisting of at least one intermetallic compound and being in the form of crystals which are transformable into an amorphous state while remaining in a solid state; and irradiating said starting material with an electron beam for at least 60 seconds to cause a solid state transformation thereof preferentially to said amorphous state, the resulting composite material having an interface between said matrix and the material in said amorphous state which is obtained by diffusion conjunction.

2. A method as defined in claim 1 wherein said intermetallic starting material is selected from the group consisting of $Zr_2Al$, $Fe_2Ti$, ZrCu, $V_3Si$, $Cu_3Ti$, NiTi, CoTi, $Cu_3Ti_2$ and iron-zirconium series compounds.

3. A method as defined in claim 1 which comprises the further step, following irradiation, of diffusion annealing the composite material at a temperature below the crystallization temperature of the material in said amorphous state, said further step being employed to strengthen said interface and produce a more intimate composite thereat.

4. A method as defined in claim 1 which comprises the further steps, following irradiation, of diffusion annealing the composite material at a temperature higher than the crystallization temperature of the material in said amorphous state, and irradiating the resultant product with said electron beam to amorphize by said solid state transformation said starting material resulting from said diffusion annealing, said further steps being employed when the temperature required for diffusion is higher than the crystallization temperature of said amorphous state.

5. A method of producing a composite material comprising the steps of positioning an intermetallic starting material at a predetermined position in a matrix, which position is at least one of within the matrix and on a surface of the matrix, said starting material consisting of at least one intermetallic compound and being in the form of crystals which are transformable into an amorphous state while remaining in a solid state; and irradiating said starting material with an electron beam having a flux density in the range $9\times10^{23}$ to $1.0\times10^{24}$ e/m$^2$· sec at a temperature in the range 170° to 230° K. for an interval of between 60 and 120 seconds to cause a solid state transformation of said starting material preferentially to said amorphous state, the resulting composite material having an interface between said matrix and the material in said amorphous state which is obtained by diffusion conjunction.

6. A method as defined in claim 5 wherein said intermetallic starting material is selected from the group consisting of $Zr_2Al$, $Fe_2Ti$, $Co_2Ti$ and $Cu_3Ti_2$.

7. A method as defined in claim 5 wherein the material of which said matrix is composed is selected from the group consisting of $Zr_3Al$, FeTi, CoTi and $Cu_4Ti$.

8. A method as defined in claim 6 wherein the material of which said matrix is composed is selected from the group consisting of $Zr_3Al$, FeTi, CoTi and $Cu_4Ti$.

9. A method as defined in claim 8 wherein said starting material is positioned on said matrix by precipitation.

10. A method as defined in claim 5 which comprises the further step, following irradiation, of diffusion annealing the composite material at a temperature below the crystallization temperature of the material in said amorphous state, said further step being employed to strengthen said interface and produce a more intimate composite thereat.

11. A method as defined in claim 5 which comprises the further steps, following irradiation, of diffusion annealing the composite material at a temperature higher than the crystallization temperature of the material in said amorphous state, and irradiating the resultant product with said electron beams to amorphize by said solid state transformation said starting material resulting from said diffusion annealing, said further steps being employed when the temperature required for diffusion is higher than the crystallization temperature of said amorphous state.

* * * * *